United States Patent [19]

Kirkwood

[11] 4,266,757

[45] May 12, 1981

[54] CORNER FENCE POST CLIP

[76] Inventor: Robert E. Kirkwood, 2251 Loma Vista Dr., Sacramento, Calif. 95825

[21] Appl. No.: 57,913

[22] Filed: Jul. 16, 1979

[51] Int. Cl.[3] ..... E04H 17/14

[52] U.S. Cl. ..... 256/65; 256/49

[58] Field of Search ..... 256/65, 62, 59, 72, 256/49, 71; 248/231, 218.4

[56] References Cited

U.S. PATENT DOCUMENTS

| | | | |
|---|---|---|---|
| 1,441,913 | 1/1923 | Darling | 248/230 X |
| 3,059,250 | 10/1962 | Mayer | 248/231 X |
| 3,136,530 | 6/1964 | Case | 256/65 X |
| 3,212,743 | 10/1965 | Culver | 248/231 X |
| 3,241,800 | 3/1966 | Richter | 248/231 X |
| 3,269,553 | 8/1966 | Ruhnke | 256/65 X |
| 3,343,811 | 9/1967 | Kusel et al. | 256/65 X |

*Primary Examiner*—Andrew V. Kundrat
*Attorney, Agent, or Firm*—Howard I. Podell

[57] ABSTRACT

A device for attachment to a tubular fence post so as to fasten horizontal fence rails or a fence panel to the fence post. Two of these devices may be fastened to a common corner fence post so as to each fasten a set of rails or panels to the common fence post at any desired angle as seen from above. The device is in the form of a channel bent at its upper end to a clip that fits over the top and into the interior of a vertical tubular fence post. Holes in the channel accommodate wire ties to fasten the channel about the fence post. Open clips are externally welded at spaced intervals to the channel and are of a size to accommodate the bent ends of horizontal fence rails which are detachably mounted to the channel clips. Since the channel may be rotated about the vertical axis of the fence post, the horizontal fence rails attached to one such channel may extend at any desired angle to a second set of horizontal rails similarly fastened to a second channel that is similarly fastened to the same fence post by the same wire ties that are employed to fasten the first channel to the post.

9 Claims, 7 Drawing Figures

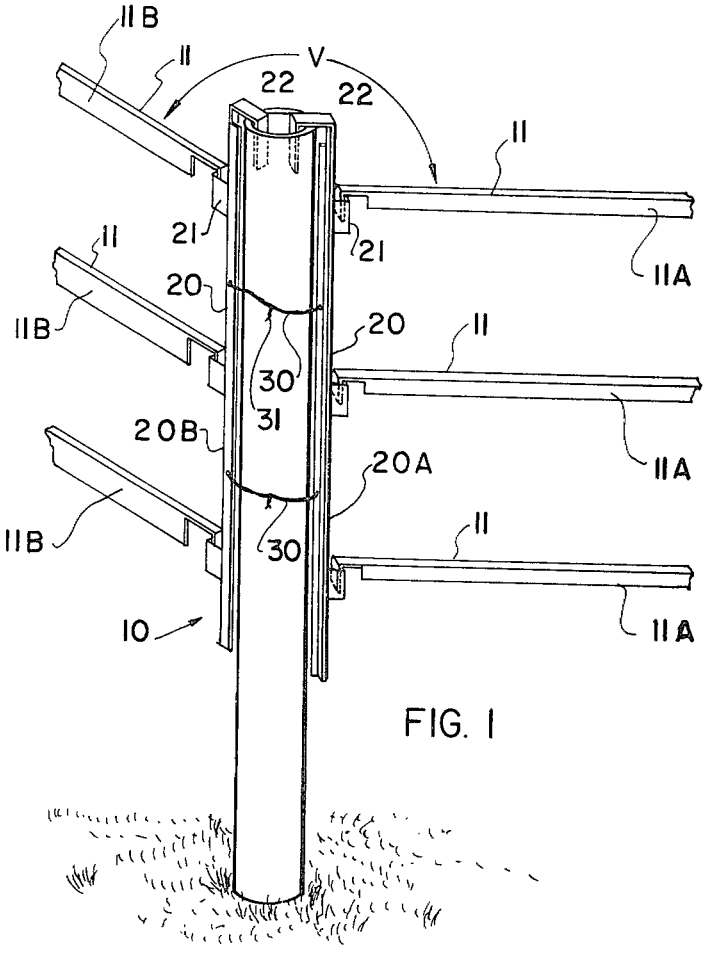
FIG. 1
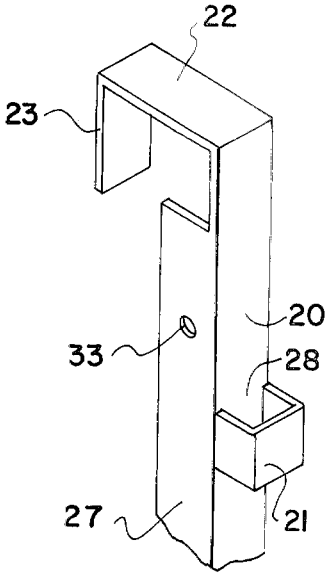
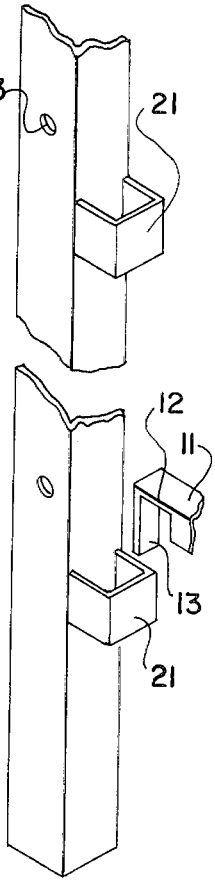
FIG. 2
FIG. 3
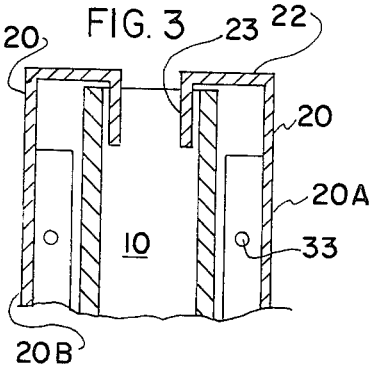
FIG. 4
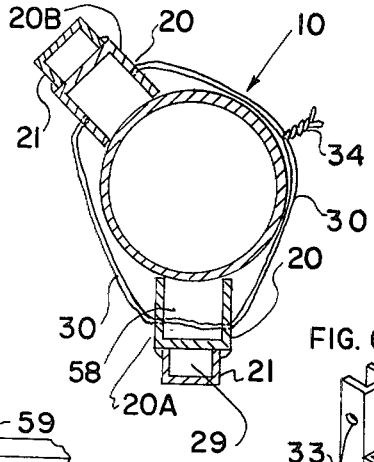
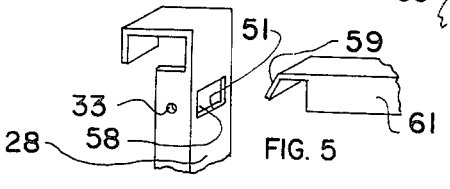
FIG. 5
FIG. 6
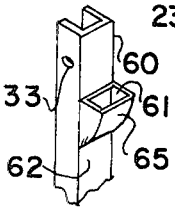
FIG. 7
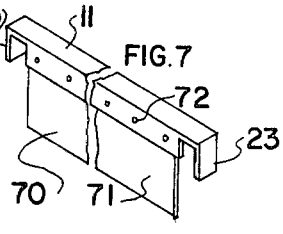

CORNER FENCE POST CLIP

FIELD OF THE INVENTION

This invention relates generally to a fence fitted with panels or rails detachably joined to spaced posts, and particularly to an attachment device which may be readily mounted to a fence post to which such panels or rails may be detachably fastened. Several such devices may be fastened to a common corner post so that the fence panels or rails may extend at any desired angle from the common post.

DESCRIPTION OF THE PRIOR ART

The prior art as exemplified by U.S. Pat. Nos. 4,073,478; 4,098,493; 2,540,995; 3,469,822; 3,767,167; 3,993,288; 3,204,606; and 2,610,830; is illustrative of many means of attachment of fencing to posts. These prior inventions, while well suited for their intended purpose, do not suggest the simplicity and effectiveness of my invention, nor do they suggest a means of detachably fastening of fencing to fence posts, as herein disclosed, in which diverging panels or rails may be readily detachably mounted to a common vertical corner fence post so as to diverge from each other at any desired angle, as seen from above.

SUMMARY OF THE INVENTION

My invention is a device for attachment to a tubular fence post so as to fasten horizontal fence rails or a fence panel to the fence post. Two of these devices may be fastened to a common corner fence post so as to each fasten a set of rails or panels to the common fence post at any desired angle as seen from above. The device is in the form of a channel bent at its upper end to a clip that fits over the top and into the interior of a vertical tubular fence post. Holes in the channel accomodate wire ties to fasten the channel about the fence post. Open clips are externally welded at spaced intervals to the channel and are of a size to accomodate the bent ends of horizontal fence rails which are detachably mounted to the channel clips. Since the channel may be rotated about the vertical axis of the fence post, the horizontal fence rails attached to one such channel may extend at any desired angle to a second channel that is similarly fastened to the same fence post by the same wire ties that are employed to fasten the first channel to the post.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of a corner fence post to which the invention is attached in use;

FIG. 2 is a perspective view of the attachment member of the invention;

FIG. 3 is a partial sectional view in elevation of the invention in use;

FIG. 4 is a plan sectional view of the invention in use;

FIG. 5 is an exploded perspective view of an alternative embodiment of the attachment member;

FIG. 6 is a perspective view of a further alternative embodiment of the attachment member; and FIG. 7 is an elevation view of an alternative fence panel for use with the invention.

DESCRIPTION OF THE PREFERRED EMBODIMENT

Turning now descriptively to the drawings, in which similar reference characters denote similar elements throughout the several views, FIG. 1 illustrates a tubular corner fence post 10 to which a first set 11A and a second set 11B of three horizontal fence rails 11 each is detachably mounted, with set 11A extending at an angle V to set 11B as seen in plain view and where angle V can be set in the field to be any desired angle required in fencing an irregular shaped section of land. While only two sets of rails are joined to post 10, it will be readily understood that three or more sets of such rails 11 may be similarly attached to a post 10. Detachable panels such as panel 70 shown in FIG. 7 may be readily substituted for any rail 11 or set of rails 11 shown in FIG. 1.

An attachment member 20 is shown in FIGS. 2–4. Member 20 is preferably formed of an open channel section with the upper end section 22 shaped to form a hook section 23 of a size to fit over the top and into the interior of a tubular fence post 10, so as to enable member 20 to hang vertically when so fastened along its length adjacent to an attached vertical post 10.

Through holes 33 are located in the side section 27 at spaced locations along the length of member 20, with each hole 33 in one side section 27 aligned directly opposed to a similar through hole 33 in the other side section as shown in FIG. 4, so that a tie wire 30 may be passed through such a pair of aligned holes 33 and tied about the pole 10 by twisting the ends 34 of the wire together so as to clamp the member 20 to the pole. Where a plurality of members 20A, 20B are clamped to a common pole as shown in FIG. 4, each tie wire 30 may pass through a pair of holes 33 in each member 20A, 20B fixed to the same hole.

V-shaped or U-shaped clips 21 are welded to the back section 28 at spaced intervals along the length of member 20 with the interior recess 29 of each welded clip 21 open to the top of the clip 21 so that a hook section 13 projecting from the end section 12 of a rail may freely fit into interior recess 29 to enable the rail to rest against the top of clip 21 so as to detachably attach the rail 11 to member 20. Rail 11 may be in the shape of an angle section, or an open or closed channel section except for a hook shaped end section 12 on each end of the rail. Alternatively a flat panel sheet 71 may be fastened by screws or rivets 72 to the intermediate section of a rail 11 to form a panel member that may be detachably joined at each end to an individual member 20 where each member 20 is joined to one of a pair of spaced fence posts 10.

As shown in FIG. 5, an alternative form of attachment member may provide for a window opening 51 in back section 28 of attachment member 50 of a size to permit the hook section 59 at the end of a rail 61 to detachably fit through window opening 51 thus eliminating the need for a clip 21. Preferably hook section 59 extends at a slight angle to the vertical plane, away from the rail 61, when rail 61 extends along a horizontal axis, so as to draw rail 61 towards member 50 as hook section 59 is lowered through window opening 51 to extend into the interior 58 of the open channel section of member 50.

FIG. 6 illustrates alternative embodiment 60 of the attachment member, in which a shaped section 65 of the back wall 62 extends outwardly from the plane of the back wall with a window opening 61 located at the top of the shaped section of a size to fit about the hook section 23 of a fence rail 11 to permit the hook section to fit through window opening 61 into the interior of the open channel section of member 50 so as to eliminate the need for a clip 21.

The invention permits a fence with detachable rails or panels to be readily erected about an irregularly shaped boundary and with a minimum of parts. The clamping of the attachment members to the fence post by tie wires enables the attachment member to be rotated about the vertical axis of the post, when erecting the fence so that each set of rails may be readily joined to two spaced fence posts without requiring precision measurements when locating the posts with regard to the angular orientation of attachment points of the rails to the posts.

The hook engagement of the attachment member to the tubular fence post over the top of the post supports the full weight of the attachment member as well as the weight of any rails or panels hanging in turn from the attachment members so that the tie wires do not bear any load caused by the weight of the fencing.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A detachable attachment to a vertical fence post to which a horizontal fence member may be detachably mounted comprising an open channel bar, a first end of which is formed with a shaped section for fastening to the top of a fence post, such that the bar will extend in a vertical direction downwards along said post with the channel facing the post in the fastened position, and at least one fastening means located on said bar to which an end of a horizontal fence member may be detachably attached, said fastening means of a shape and located on said bar so that a horizontal fence member when attached by said fastening means will extend in a first horizontal direction from said bar, in which the said first end of the bar is formed with a hook-shaped section in the form of a detent of a shape to detachably latch about the top and into the interior chamber of a hollow fence post or into the interior of a fence post formed with a hollow interior chamber that is open to the top of said fence post, so as to suspend the bar from the top of said post when said detent is latched about the said post top, said detent located to extend from the bar in a second horizontal direction opposed to the first horizontal direction that a said attached horizontal fence member extends.

2. The invention of claim 1, further including clamp means located for clamping an intermediate section of a said bar to a fence post from the top of which post the shaped section of the bar is suspended.

3. The invention of claim 1, in which a plurality of similar-shaped clip means are located in spaced array on the bar so as to enable a plurality of spaced separated individual horizontal members to be fastened to the bar.

4. The invention of claim 1, further including a horizontal fence member in the form of a rail, which rail is fitted on at least one end with a shaped section of a shape to detachably fasten to a clip means of an installed bar so as to suspend the rail on a generally horizontal axis when the other end of the rail is suspended from a height of the substantial elevation of the said clip means.

5. The invention of claim 2, in which the clamp means comprises in the bar of at least one set of spaced through apertures extending through opposed sides of the bar, together with a tie wire which may be passed through said apertures and about the post so as to clamp the bar to the post.

6. The invention of claim 1, in which the fastening means is each in the form of a U-shaped bracket fixed, at the end of each of two leg members, to a side of the bar, with each leg member attached to a common intermediate section bounding an interior recess section when so fixed, with the said interior recess section of the U-shaped member open to the top of the fastening means, in the installed position.

7. The invention of claim 1, in which the fastening means is an opening in a wall of the channel member of a size to receive a shaped end section of a horizontal member.

8. The invention of claim 1, further including a panel fitted at each of two opposed ends with a shaped section of a size to fit detachably to the fastening means, so that the panel may serve as the fence member when detachably mounted to two bars each suspended from a different one of two spaced fence posts.

9. The invention as recited in claim 1 further comprising a fence post, the upper end of which is formed with a hollow interior chamber open to the top of the post.

* * * * *